United States Patent [19]

Nepper et al.

[11] Patent Number: 4,523,836

[45] Date of Patent: Jun. 18, 1985

[54] CONTINUOUS COPIER

[75] Inventors: Robert F. Nepper, North St. Paul; Alan J. Solyntjes, Minneapolis; Carl W. Abrahamson, Lake Elmo, all of Minn.

[73] Assignee: Minnesota Mining and Manufacturing Company, St. Paul, Minn.

[21] Appl. No.: 518,645

[22] Filed: Jul. 29, 1983

[51] Int. Cl.[3] ..... G03G 15/00

[52] U.S. Cl. ..... 355/16; 355/3 SH; 355/14 SH

[58] Field of Search ..... 355/13.16, 3 SH, 14 SH, 355/3 FU; 226/199; 242/75.5, 75.4

[56] References Cited

U.S. PATENT DOCUMENTS

| | | | |
|---|---|---|---|
| 1,638,560 | 8/1927 | Beveridge | 226/199 |
| 3,826,442 | 7/1974 | Bethke | 242/75.5 |
| 4,193,330 | 3/1980 | Knox | 83/364 |
| 4,265,153 | 5/1981 | Price, Jr. | 83/372 |

*Primary Examiner*—A. T. Grimley
*Assistant Examiner*—David Warren
*Attorney, Agent, or Firm*—Donald M. Sell; James A. Smith; David W. Anderson

[57] ABSTRACT

A copy machine capable of producing indeterminate length copies of an exceptionally long original and including a terminal set of drive rollers which pull copy paper through the machine and a brake which is connected to a supply of continuous copy paper and which may be selectively engaged to produce a drag on the copy paper and place the paper in tension between the supply and the terminal rollers.

4 Claims, 5 Drawing Figures

CONTINUOUS COPIER

BACKGROUND OF THE INVENTION

1. Field of the Invention

This invention relates generally to roll-fed copying machines and, more particularly, to the apparatus and electrical circuitry which allows the machine to produce extended length copies, which may exceed 100 feet in length.

2. Description of the Prior Art

Roll-fed copy machines such as those disclosed in U.S. Pat. Nos. 4,193,330 and 4,265,153 operate admirably to produce copies of standard sized documents which may range up to 14 inches in length. There exist applications, however, where it is required to produce a continuous copy of an original document having a length greatly in excess of that of standard documents. Documents such as oil well logs or electrocardiagrams may easily exceed 100 feet in length.

Such documents cannot be copied onto a continuous sheet of copy paper by the machines disclosed in the above-noted patents because an attempt to feed such a continuous length of copy paper through the copying machine results in wrinkling of the copy paper and side-to-side wandering of the paper with respect to the copy paper feed rolls of the machine and consequent jamming of the copy paper within the copying machine.

SUMMARY OF THE INVENTION

The present invention allows continuous copying of an indeterminate length of paper, which may exceed 100 feet, to be produced in a copying machine which includes a transferring mechanism consisting of a series of rollers which transfer copy paper from a supply to a paper exit. The invention provides a terminal set of rollers adjacent the paper exit which engage and transport the copy paper at a speed which is in excess of the speed at which the paper is driven by any transport rollers between the paper supply and these terminal rollers adjacent the exit. Means is provided to sense the engagement of the copy paper by these terminal rollers and engage a brake attached to the paper supply to apply a drag on the paper supply. Tension on the copy paper between the terminal rollers and the paper supply is thus produced which has been found to eliminate side-to-side wander of the paper in the transport rollers and thus ensure that the copy paper tracks properly across the exposure, developing and fixing stations of the copying machine.

Additionally, a bowed paper guide is provided which reduces or eliminates wrinkles in the copy paper as it proceeds through the machine and a switch senses the end of the original document to disengage the copy paper supply brake prior to the copy paper being cut to the length of the original document.

BRIEF DESCRIPTION OF THE DRAWINGS

The present invention will be more thoroughly described with reference to the accompanying drawings wherein like numbers refer to like parts in the several views, and wherein.

DESCRIPTION OF THE PREFERRED EMBODIMENTS

Figure 1:
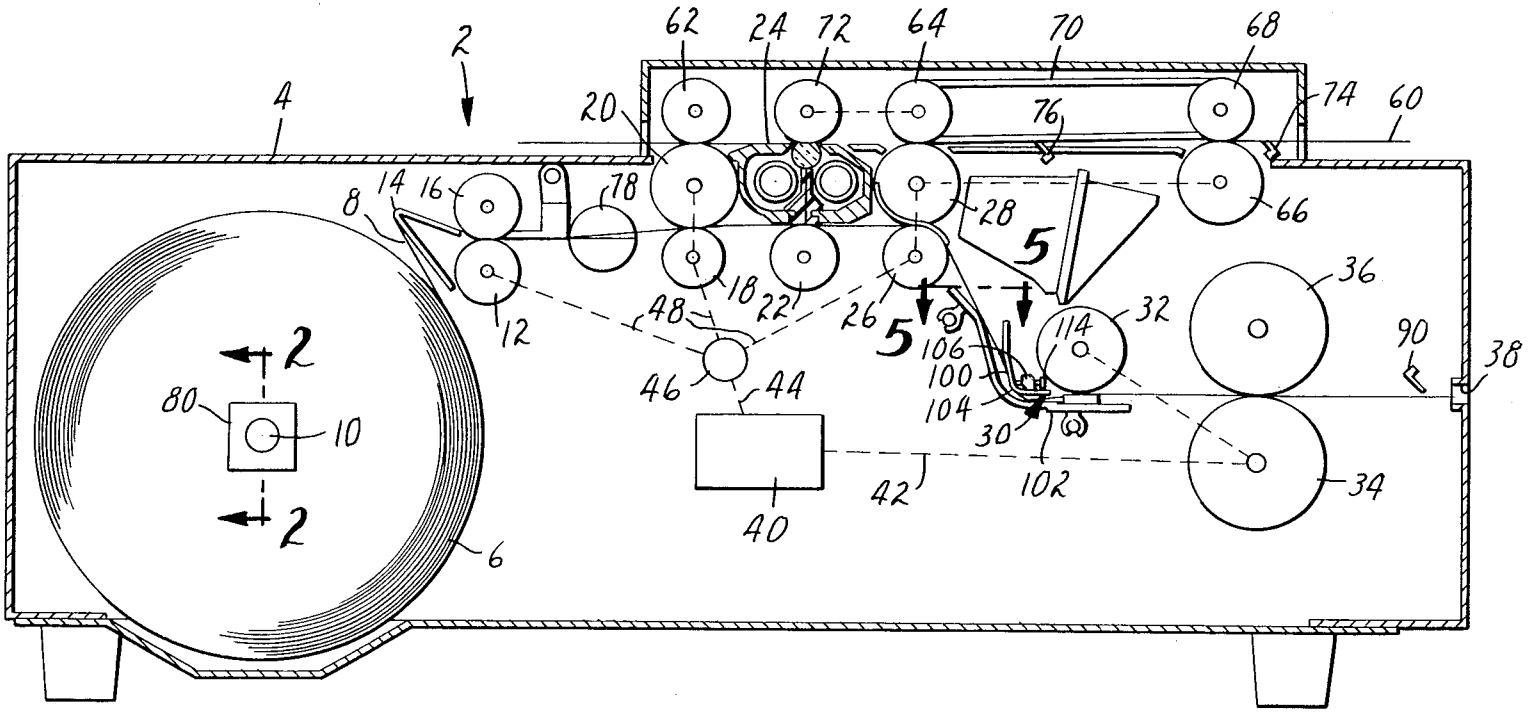
FIG. 1 is a diagrammatic side elevational view of an electrically operated copying machine embodying the present invention.

Referring to FIG. 1, a diagrammatic side elevational view of an electrically operated copy machine 2 is shown which includes a housing 4 in which a supply roll 6 of copy paper 8 is positioned for rotation counterclockwise about a shaft 10. For the type of copy machine 2 to be described, the copy paper 8 is a zinc oxide coated paper such as that available from the Minnesota Mining and Manufacturing Company of St. Paul, Minn. under the designation Type 470. The copy paper 8 is moved through the copy machine 2 by a transferring mechanism which includes a first feed roller 12 which receives the copy paper 8 from the supply roll 6 via a guide member 14. An idler roller 16 positioned above the feed roller 12 forms a nip with the roller 12 through which the copy paper 8 is moved when the roller 12 is driven. A second feed roller 18 and a cooperating charge roller 20, positioned above the roller 18, serves to place a uniform electrical charge on the zinc oxide surface of the copy paper 8 in addition to transporting the paper 8. A roller 22 receives the copy paper 8 from the rollers 18 and 20 and keeps the paper 8 in close contact with an exposure station, indicated generally as 24. A drive roller 26 plus an idler roller 28, positioned above the roller 26, receive the paper 8 therebetween from the roller 22 and move it toward a developer station, indicated generally as 30. The developer station includes a developer roller 32 used to apply toner particles (not shown) to the copy paper 8. A driven pressure fixing roller 34 and a cooperating idler roller 36, positioned above the roller 34, receive the copy paper 8 as it travels past the developer roller 32 and move the copy paper 8 via an exit opening 38 in the housing 4 to an area outside of the housing 4. The path taken by the copy paper 8 is shown by the solid line that extends from the copy paper supply roll 6 to the right side of the housing 4 and the exit opening 38.

A drive motor 40 is also part of the transferring mechanism and provides the driving force for the mechanism. A direct drive connection, indicated by dashed lines 42 and 44, is provided between the drive motor 40 and the pressure roller 34 and a one-way clutch assembly 46, respectively. A secondary drive connection, indicated by dashed lines 48, is provided between the clutch assembly 46 and the rollers 12, 18 and 26. A chain drive is preferably used to provide the direct drive connections 42 and 44 and the secondary drive connections 48.

The one-way clutch assembly 46 may be of the type which includes a number of rollers held within a cage having sloped areas corresponding to the rollers, such as are manufactured by the Torrington Company of Torrington, Conn. A clutch assembly 46 of this type is well known and will operate to transmit torque from the direct drive connection 44 to the secondary drive connections 48 if the direct drive connection 44 is driven faster than the secondary drive connections 48, but will allow the secondary drive connections 48 to overrun the direct drive connection 44 if the secondary drive connections 48 are driven at a faster rate. Thus the one-way clutch assembly 46 will cause the rollers 12, 18 and 26 to be driven by the motor 40 and will also allow the rollers 12, 18 and 26 to rotate at a speed greater than that supplied by the motor 40 if the rollers 12, 18 and 26 are so driven by means other than the motor 40.

It is necessary when making a copy of an original sheet that movement of the original sheet and the copy paper 8 be synchronized so their leading edges reach the exposure station 24 at the same time. The transferring mechanism of the copy machine 2 that serves to provide such movement of an original sheet includes a portion of the transferring mechanism used in moving the copy paper 8 through the machine 2. An original sheet passes in FIG. 1 from right to left along the path indicated by the line 60. The charge roller 20 and the feed roller 18, which are used in the transferring mechanism for the copy paper 8, are also directly used as part of the transferring mechanism for the original sheet presented to the copier 2. The roller 18 is coupled, as indicated by the dashed line, to the drive charge roller 20. Gears or a chain may be used to provide this coupling. An idler roller 62 is positioned above and cooperates with the roller 20. A similar coupling arrangement is provided between the rollers 26 and 28 with a roller 64 positioned above the roller 28. The roller 28 is also coupled, as indicated by the dashed line, to drive a feed roller 66 positioned at the right portion of the machine 2 where an original is initially inserted. The roller 28 may be coupled to the feed roller 66 by a timing belt (not shown). The feed roller 66 has a roller 68 positioned above it which is coupled to the roller 64 by a number of o-ring belts 70 (only one of which is shown) positioned in axially spaced parallel relationship along the rollers 64 and 68. A roller 72 is positioned adjacent the exposure station 24 opposite the roller 22. The roller 72 is biased toward the exposure station 24 and is a driven roller, being coupled, as indicated by the dashed line, to the roller 64. Such coupling can be provided by a timing belt (not shown). With the drive motor 40 operating, the portion of the transferring mechanism just described is effective to move an original sheet along the path indicated by the line 60 past the exposure station 24 and to an exit point to the left of the rollers 20 and 62.

Two snap-acting type switches 74 and 76 of the single-pole configuration are positioned in the flow path 60 of the original sheet. Switches of this type are well known and commercially available from several sources. The purpose and operation of the first switch 74 encountered by the original sheet will be described below. The second switch 76 encountered by the original sheet as it travels along the path 60 is operatively connected to a solenoid controlled cutter 78 which is provided along the path of the copy paper 8 and is positioned between the first feed roller 12 and the second feed roller 18. The interconnection between the switch 76 and the cutter 78 and the operation of the cutter 78 is described in detail in U.S. Pat. No. 4,265,153, which is incorporated herein by reference.

In order to produce extended length continuous copies of exceptionally long documents such as oil well logs and electrocardiagrams, it has been found that the copy paper 8 must be maintained in tension between the supply roll 6 and the pressure roller 34 or else the copy paper 8 will wander from side to side within the copy machine 2 and not track properly. This wandering may result in reduced copy accuracy and quality and may cause the copy paper 8 to become jammed within the machine 2 if the wandering is excessive. To provide the required tension between the pressure roller 34 and the supply roll 6, the pressure roller 34 is driven by the motor 40 at a rotational velocity which will transport the copy paper 8 at a speed in excess of the speed imparted to the copy paper 8 by the feed rollers 12 and 18 and the pressure roller 26. In addition, the supply roll 6 is provided with a brake 80 to ensure that a predetermined and constant tension is maintained on the copy paper 8.

Figure 2:
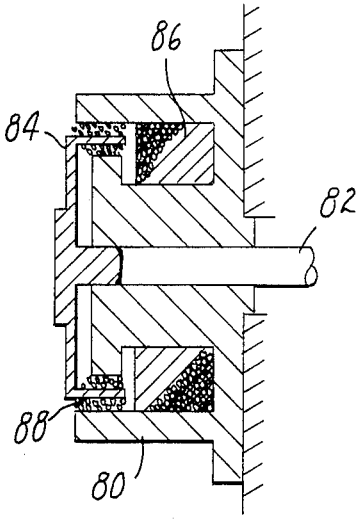
FIG. 2 is a sectional view of a copy paper supply brake taken generally along the line 2—2 of FIG. 1.

The brake 80 is preferably of the particle type such as that manufactured by Innovex, Inc. of Hopkins, Minn. The brake 80 is shown in FIG. 2 and includes a shaft 82 connected to and rotatable with the supply roll shaft 10, a drag disc 84, a winding 86 and ferrous particles 88 contained within the brake 80 by a seal (not shown). When the winding 86 is energized, the ferrous particles 88 are suspended in the path of the drag disc 84 and frictionally resist rotation of the disc 84 to provide a drag on the supply roll shaft 10 and, consequently, the supply roll 6. Although the supply roll 6 could be provided with a fixed frictional resistance to rotation, it is preferable to use a brake 80 which may be de-energized to provide free rotation of the supply roll 6 in order to facilitate feeding of the copy paper 8 to the pressure roller 34 and to prevent marking of the copy paper 8 which occurs when the paper 8 is cut while under tension because of a sudden paper speed change at the exposure station 24.

To energize and de-energize the brake 80 at proper times during operation of the copy machine 2, the machine 2 is provided with the switch 74 in the path 60 of an original sheet and a snap-acting type switch 90 in the path of the copy paper 8 and located between the pressure roller 34 and the housing exit opening 38.

Figure 3:
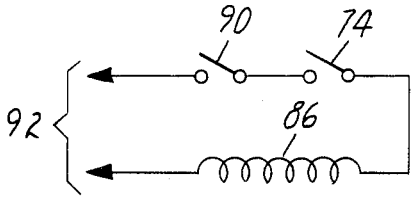
FIG. 3 is a schematic view of the control circuitry used with the copying machine of FIG. 1.

A control circuit utilizing switches 74 and 90 is shown in FIG. 3. The position in which the switches 74 and 90 are shown shall hereinafter be referred to as the first position. It is the position the switch 74 automatically assumes when it is not responding to the presence of an original sheet and the position the switch 90 automatically assumes when it is not responding to the presence of the copy paper 8. The other positions, which are assumed by the switches 74 and 90 when responding to the presence of an original sheet and the copy paper 8, respectively, shall hereinafter be referred to as the second position. The control circuit includes a source of power 92, one side of which is connected to the fixed contact associated with the switch 90 and the other side of which is connected to one side of the brake winding 86. The other end of the brake winding 86 is connected to the movable contact of the switch 74. The fixed contact of the switch 74 is connected to the movable contact of the switch 90. When both of the switches 74 and 90 are in their second positions, a circuit loop is completed which energizes the brake winding 86 and provides a drag on the supply roll 6. When either of the switches 74 or 90 is in its first position, the brake winding 86 is de-energized and the supply roll 6 will rotate freely.

OPERATION

Prior to insertion of an original sheet, the leading edge of the copy paper 8 is located at the cutter 78 and all rollers with the exception of the first feed roller 12 and its associated idler roller 16, are driven by the motor 40. The first feed roller 12 is not driven because a solenoid operated clutch (not shown) is located between the secondary drive connection 48 and the first feed roller 12. Upon insertion of an original into the machine 2, the switch 74 is moved to its second position, but the supply reel brake 80 is not energized because the switch 90 remains in its first position. Subsequent movement of the original by the belt 70 actuates the switch 76 which operates the clutch associated with the first feed roller 12 in a manner described in U.S. Pat. No. 4,265,153 and initiates feed of the copy paper 8 through the copy machine 2. The copy paper 8 is fed through the copy machine 2 by the rollers 12, 18 and 26 until the copy paper 8 reaches and is engaged by the pressure roller 34 and its associated idler roller 36. The pressure roller 34 is driven at a rotational velocity which imparts a speed to the copy paper 8 which is in excess of the speed imparted to the copy paper 8 by the rollers 12, 18 and 26. Consequently, the speed of the copy paper 8 is increased when it is engaged by the pressure roller 34 and the copy paper 8 is pulled through the machine 2 by the roller 34. This is possible because the rollers 12, 18 and 26 are driven through the one-way clutch assembly 46 which allows the rollers 12, 18 and 26 to be driven at a speed in excess of that provided by the motor 40. Upon exiting the pressure roller 34 and approaching the housing exit opening 38, the copy paper 8 contacts the switch 90 and moves the switch 90 to its second position whereupon the brake winding 86 is energized and the brake 80 is applied to provide a frictional drag on the supply roll 6 and place the copy paper 8 in tension between the supply roll 6 and the pressure roller 34. This tension on the copy paper 8 ensures that the copy paper 8 tracks properly through the machine 2 and because the copy paper 8 is provided in the form of a continuous roll 6, copying of the original sheet can proceed for any length. Thus, an original sheet of any length can be copied onto a single, continuous sheet of copy paper 8, limited only by the amount of copy paper 8 contained on the supply roll 6.

When the end of the original sheet passes beyond the switch 74, the switch 74 returns to its first position to open the circuit loop containing the brake winding 86 and permit the supply roll to rotate freely. Return of the switch 76 to its first position by continued motion of the original sheet actuates the cutter 78 to cut the copy paper 8 in a manner described in U.S. Pat. No. 4,265,153. Thus, the feed of copy paper 8 from the supply roll 6 is halted, but since the pressure roller 34 continues to be driven by the motor 40, the copy paper 8 is transported past the developer station 30 and out of the housing exit opening 38. Passage of the copy paper 8 past the switch 90 allows the switch 90 to return to its first position which completes an operating cycle of the copy machine 2. The machine 2 is then ready to begin the above-described process once again.

Although the pressure roller 34 has been described as the roller which is driven at the greatest rotational velocity to pull the copy paper through the machine 2, it is not necessary that the roller which provides the tension on the copy paper 8 be the pressure roller 34. Another set of rollers beyond the pressure roller 34 could be provided to produce the required tension on the copy paper 8. All that is required for proper paper 8 tracking through the machine 2 is that the rollers which provide tension on the copy paper 8 be the last rollers through which the paper 8 passes before exiting through the opening 38.

Figure 4:
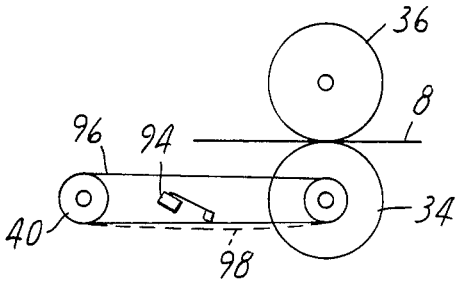
FIG. 4 is a schematic view of an alternate embodiment of a portion of the control circuitry of FIG. 3.

It is also not necessary that the switch 90 be actuated by the copy paper 8 itself. What is required is that the switch 90 be capable of sensing that the pressure roller 34 and its associated idler roller 36 have engaged the copy paper 8. This could be accomplished as shown in FIG. 4 wherein a switch 94 is positioned to engage a chain 96 which corresponds to the direct drive connection 42 between the motor 40 and the pressure roller 34. The absence of copy paper 8 between the pressure roller 34 and its associated idler roller 36 will result in little torque being required to rotate the rollers 34 and 36. The lower strand 98 of the chain 96 will thus hang with a slackness which will not permit the lower strand 98 to contact and actuate the switch 94. When the copy paper 8 is engaged by the pressure roller 34, an increased torque on the pressure roller 34 will be necessary to pull the copy paper 8 through the copy machine 2. This increased requirement for torque will result in the lower strand 98 of the chain 96 having a reduced slackness and rising to actuate the switch 94. Thus, the switch 94 could be used in the manner of the switch 90 to energize the brake winding 86 even though the switch 94 is not directly contacted by the copy paper 8.

Figure 5:
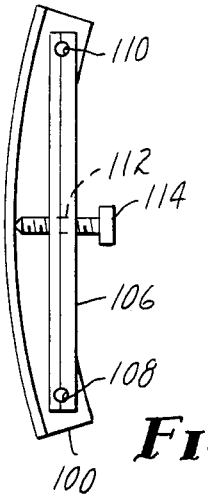
FIG. 5 is a plan view of a portion of the copy paper path viewed generally from the perspective of line 5—5 of FIG. 1.

In order to properly direct the copy paper 8 from the roller 26 beyond the developer station 30 and to the pressure roller 34, and also to maintain the copy paper 8 at a proper distance from the developer roller 32, the copy machine 2 is provided with an upper paper guide 100 and a lower paper guide 102. When the copy paper 8 has been engaged by the pressure roller 34 and is in tension between the roller 34 and the supply roll 6, the copy paper is drawn around a rounded corner 104 of the upper paper guide 100 and spaced a proper distance from the developer roller 32. This contact between the copy paper 8 and the upper paper guide 100 may be the cause of wrinkles which have been found to occur in the copy paper 8. It has been discovered that these wrinkles can be eliminated by bowing the upper paper guide 100 so that the center of the copy paper 8 is subject to greater tension than the edges. This bowing is shown in FIG. 5 and is greatly exaggerated for clarity. Bowing of the upper paper guide 100 is produced by providing a stiffener 106 which is attached to the upper paper guide 100 and the housing 4 at bolt holes 108 and 110. The stiffner 106 is provided with a central threaded through-hole 112 through which a bolt 114 may be threaded to bear upon the upper paper guide 100 and force the center of the upper paper guide 100 outwardly with respect to its ends.

A copy machine 2 which will produce extended length continuous copies of exceptionally long original sheets has been described with respect to certain particular embodiments. It is expected that modifications of these specific embodiments will be apparent to those skilled in the art. Such modifications are intended to be considered a part of this invention if they fall within the scope of the appended claims.

We claim:

1. A copy machine capable of producing extended indeterminate length copies comprising:

a housing including a paper exit;

a supply of continuous copy paper mounted within said housing;

a series of rollers for transporting said paper through said housing and ending in a terminal pair of rollers adjacent said paper exit which engage said paper and transport said paper at a speed in excess of the speed at which said paper is transported by any other of the rollers in said series so that said paper is pulled through said machine by said terminal rollers;

means for sensing the engagement of said paper by said terminal rollers; and means responsive to said sensing means for selectively applying a drag to said supply of copy paper so that said copy paper is in tension throughout said machine between said terminal rollers and said supply of copy paper.

2. A copy machine according to claim 1 wherein said means for selectively applying said drag to said supply of copy paper comprises an electrically operated brake connected to said supply of copy paper.

3. A copy machine according to claim 2 wherein said means for sensing comprises a switch operatively connected to said brake and positioned to be actuted by said paper as said paper exits said terminal rollers.

4. A copy machine according to claim 1 further including a supply of copy paper guide positioned between said paper and said terminal rollers and which is bowed from the center of said guide toward the ends of said guide so that a greater tension is applied to the center of said paper than the ends of the paper.

* * * * *

UNITED STATES PATENT AND TRADEMARK OFFICE

CERTIFICATE OF CORRECTION

PATENT NO. : 4,523,836

DATED : June 18, 1985

INVENTOR(S) : Robert F. Nepper et al

It is certified that error appears in the above-identified patent and that said Letters Patent is hereby corrected as shown below:

Claim 3 (column 8, line 5), "actuted" should read -- actuated --.

Signed and Sealed this

*Twenty-fourth* Day of *December 1985*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,523,836

DATED : June 18, 1985

INVENTOR(S) : Robert F. Nepper et al.

It is certified that error appears in the above-identified patent and that said Letters Patent is hereby corrected as shown below:

Column 8, line 8, delete "supply of copy".

Column 8, line 9, before "paper" insert -- supply of copy --.

Signed and Sealed this

*Eighteenth* Day of *February 1986*

[SEAL]

*Attest:*

DONALD J. QUIGG

*Attesting Officer*

*Commissioner of Patents and Trademarks*